United States Patent [19]

Tokorozawa et al.

[11] 4,365,728

[45] Dec. 28, 1982

[54] LIQUID DISCHARGE APPARATUS

[75] Inventors: Sadao Tokorozawa, Nakai; Toyoji Shimizu, Oi, both of Japan

[73] Assignee: Pilot Man-Nen-Hitsu Kabushiki Kaisha, Tokyo, Japan

[21] Appl. No.: 18,394

[22] Filed: Mar. 7, 1979

[30] Foreign Application Priority Data

Mar. 13, 1978 [JP] Japan ..... 53-28391

[51] Int. Cl.[3] ..... B67D 5/54; B43K 5/02

[52] U.S. Cl. ..... 222/209; 222/63; 401/188 A; 417/477

[58] Field of Search ..... 222/401, 402, 420, 61, 222/63, 209, 214; 401/188 A, 188 R; 318/328; 417/477, 476, 44, 45, 412

[56] References Cited

U.S. PATENT DOCUMENTS

| | | | |
|---|---|---|---|
| 1,951,057 | 3/1934 | Leitch | 401/188 A |
| 2,017,145 | 10/1935 | Dunn | 222/401 |
| 2,188,802 | 1/1940 | Beckett | 222/420 |
| 2,709,542 | 5/1955 | Eller et al. | 222/209 |
| 2,876,406 | 3/1959 | Charbonneaux et al. | 318/328 X |
| 3,111,897 | 11/1963 | Van Buskirk | 417/477 X |
| 3,137,242 | 6/1964 | Hahn | 417/477 |
| 3,384,080 | 5/1968 | Muller | 222/214 X |
| 3,415,419 | 12/1968 | Jewett et al. | 417/477 X |
| 3,529,226 | 9/1970 | Correll et al. | 318/328 X |
| 3,572,400 | 3/1971 | Casner et al. | 222/420 X |
| 3,596,159 | 7/1971 | Kato | 318/328 X |
| 3,781,142 | 12/1973 | Zweig | 417/477 |
| 3,921,858 | 11/1975 | Bemm | 401/188 A X |
| 4,108,575 | 8/1978 | Schäl | 417/477 X |
| 4,221,543 | 9/1980 | Cosentino et al. | 417/45 X |

FOREIGN PATENT DOCUMENTS

| | | | |
|---|---|---|---|
| 604032 | 8/1960 | Canada | 222/401 |
| 2521694 | 4/1975 | Fed. Rep. of Germany | 222/401 |

*Primary Examiner*—Robert B. Reeves
*Assistant Examiner*—Edward M. Wacyra
*Attorney, Agent, or Firm*—Sughrue, Mion, Zinn, Macpeak & Seas

[57] ABSTRACT

A liquid discharge device using a peristaltic pump having a depression and delivery system including an elastic tube for introducing compressed air into a liquid reservoir to be maintained in a selective pressurized state. A motor drive circuit is adjusted to vary motor rotation to sequentially squeeze and release one end of the elastic tube thereby varying the rate of pressurization in the reservoir.

9 Claims, 7 Drawing Figures

LIQUID DISCHARGE APPARATUS

BACKGROUND OF THE INVENTION

This invention relates to a liquid discharge apparatus by which the discharge rate of liquid can be easily adjusted to match the speed of a user's pen and which is suitably for the applying and filling operations of liquid.

In a conventional liquid discharge apparatus for applying liquid by holding an applicator by hand, both ends of a cylindrical applicator containing application liquid are provided with a cylindrical projection having a small diameter. One of the cylindrical projections is connected to a discharge nozzle and the other is coupled with an elastic hose for introducing air. Compressed air is supplied into the applicator through the hose for the liquid application operation.

While this apparatus is advantageous in the application of viscous liquids, the supply of the compressed air must be generally achieved by means of compressor, pressure regulator and flow adjusting valve. Accordingly, low pressure air cannot be continuously supplied into the applicator and the fine adjustment of air flow is extremely difficult.

As a result, the user has to move the pen according to the discharge rate from the applicator, needing high skill and knowledge of the characteristics of an individual piece of equipment. Furthermore, in the use of such liquid discharge apparatus, for example, during the filling operation of small amounts of fluid into recesses having varying widths such as the Ming dynasty letters, subsequent processes such as wiping-off, repair, etc., are required, thereby resulting in degradation of working efficiency.

SUMMARY OF THE INVENTION

Accordingly, an object of this invention is to eliminate the above-described drawbacks of the prior art.

It is another object of this invention to provide a liquid discharge apparatus having the capability of fine adjustment to suit user requirements.

A further object of this invention is to provide a liquid discharge apparatus that is sanitary and eliminates polluting discharges.

Briefly, these objects are accomplished by the realization that low pressure air can be supplied by a peristaltic pump squeezing and releasing successively an elastic tube and the speed of such squeezing and releasing can be easily varied by a simple adjustment system.

A liquid discharge apparatus according to this invention comprises a peristaltic pump having a depression and delivery system which includes an elastic tube having an air intake end for introducing air, a pusher sequentially squeezing and releasing the tube, and a drive shaft connected with the forced feed means. A motor is connected with the drive shaft and a speed setting device is electrically connected to the motor to direct the rotational speed of the motor. An air discharge of the tube is located within a liquid pressure reservoir and a nozzle is attached to the liquid pressure reservoir.

This invention is further characterized in that the peristaltic pump is driven by the motor having the speed controlled by the speed setting device to suck and feed air to the liquid pressure reservoir for pressurizing the liquid therein. Accordingly even during movement of the pen the discharge amount can be increased and decreased by the operation of the speed setting device. Hence, the peristaltic pump is the most suitable. In the case of using the other pumps which cannot be adjusted to the desired air pressure, the discharge amount matching with the movement of user's pen is not obtained.

The peristaltic pump according to this invention may be of the type where the squeezing and releasing of the elastic tube are carried out by the raising and lowering of at least three pushers provided on the forced feed means. Alternatively, it may be of the type where at least two roller-shaped pushers of the forced feed means are arranged to revolve along a circular path to press the elastic tube press-fitted between the circular path and the pushers, or of the type that at least two roller-shaped pushers of the forced feed means which are arranged along the elastic tube placed on a flat surface circulate to press the elastic tube.

The variable speed type motor used for this invention comprises one which can vary the speed by discrete steps or one which can vary the speed in an analog mode.

The speed setting device to direct the rotational speed of the motor may be a voltage control system, frequency converting system, etc. If a voltage control system is employed, both open loop control and closed loop control can be used. When an open loop control system is used, any of voltage regulator (A) combined with torque motor, or the voltage regulator (B) combined with induction motor or reversible motor. However, the voltage regulation (A) with a wider control range is preferable for use as the speed setting device, but in any case the speed is varied by the change of power supply voltage and load. In the closed loop control system a control circuit combined with speed control motor is employed. The closed loop control system is preferable when compared with the open loop control system because the control range is wide and the speed variation due to the change of the power source voltage and the load is substantially zero. The frequency converting system may comprise a variable frequency power supply combined with an induction motor or reversible motor. However, this is disadvantageous in that the control range is narrow and the speed is varied by the change of the power source voltage and the load. Consequently, in the present invention any of the speed setting means can be used, however, in view of function and effect mentioned above, the closed loop control system is most preferable.

The liquid discharge apparatus according to the present invention can be used for substantially any kind of liquid, particularly for relatively high viscous liquid, for example, ink, paint, adhesives, oil, flux, lubricating oil, cosmetic material, machine oil, resins, food material, paste-like material, solid material, liquid dispersing material, etc. This invention will be described with respect to the drawings and the description of the preferred embodiment that follows.

DETAILED DESCRIPTION OF THE INVENTION

Figure 1:
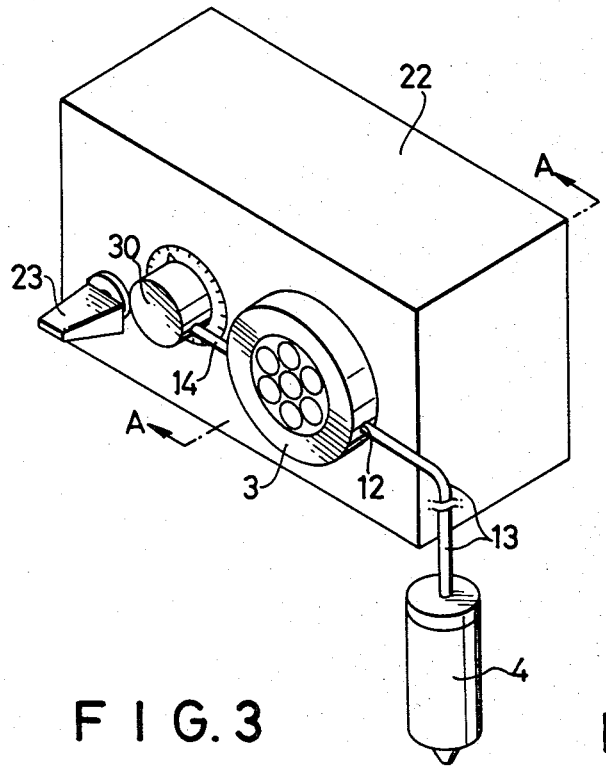
FIG. 1 is a perspective view of a portion of the liquid discharge apparatus constructed according to this invention.
Figure 3:
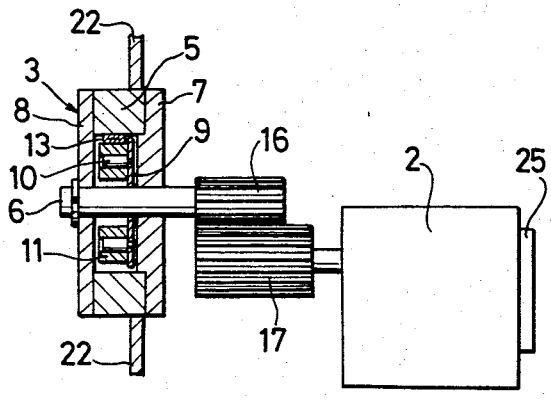
FIG. 3 is a sectional view taken along line A—A in FIG. 1.
Figure 2:
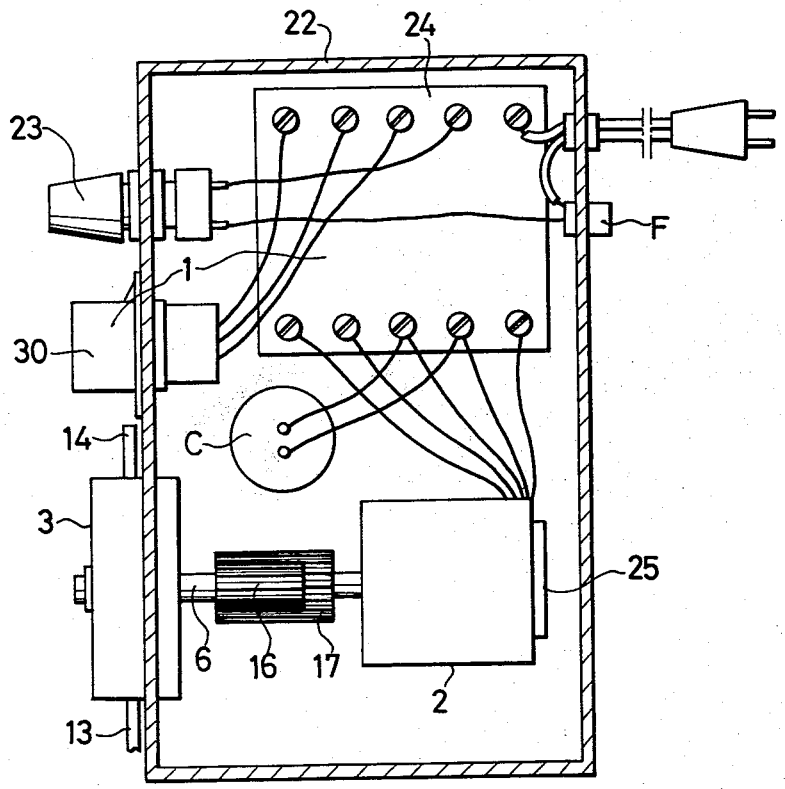
FIG. 2 is a fragmentary sectional view of a peristaltic pump used for the liquid discharge apparatus.

A liquid discharge apparatus shown in FIGS. 1 to 3 comprises a speed setting device 1, a variable speed type motor 2, a peristaltic pump 3 and a discharging device 4. As shown in FIG. 3, the openings of annular case 5 are covered with a bottom plate 7 and a cover plate 8 provided respectively with a hole which serves as bearings of a drive shaft 6. The drive shaft 6 journaled by the bottom plate 7 and the cover plate 8 is provided with a disk 9 rotating therewith. Six pins 10 are embedded at equal intervals in the disk 9 on a coaxial circle of the drive shaft 6. Six cylindrical rollers 11 are respectively mounted on the pins 10 at intervals so that they are rotatable without contacting each other. The rollers 11 are arranged to revolve about the drive shaft 6 by the rotation of the disk 9.

Hole-shaped outlets 12 (FIG. 1) are respectively provided at diametrically opposite portions of the surface of the case 5. An air introducing elastic tube 13 with a diameter larger than the slot width of the outlet 12 is inserted into the outlet under a pressure sufficient to press-fit it between the roller 11 and the inner wall of the case 5. Reference numbers 14, 15 shown in FIGS. 1 and 4 respectively designate the air intake end and the air discharge end of the tube. A gear 16 of the drive shaft 6 meshes with a gear 17 of the variable speed motor 2.

Figure 4:
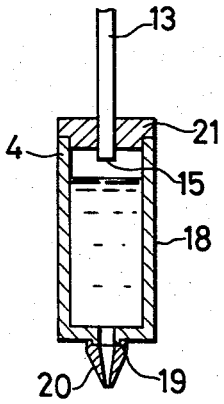
FIG. 4 is a sectional view of a discharging device used for the liquid discharge apparatus.

The discharging device 4 shown in FIG. 4 is provided on the lower end of a cylindrical liquid pressure reservoir 18 for delivering liquid to a cylindrical projection 19 having small diameter, from which projection a nozzle 20 protrudes. Also a sealing plug 21 is fitted into the top of the reservoir 18 and the tube 13 is fixedly fitted into the sealing plug 21 to open the air discharge end 15 of the tube 13 into the discharging device 4.

The peristaltic pump 3 is attached to the wall surface of a casing 22. Within the casing 22 (FIG. 2), the variable speed motor 2 and a control pack 24 electrically connected to the motor 2 are coupled to a power supply switch 23 and a variable resistor 30 is connected to the control pack 24, respectively, to thereby supply the necessary electric power. In FIG. 2, the reference numerals F and C respectively designate a fuse and a condenser. The speed setting device 1 according to the present invention comprises the variable resistor 30, the control pack 24 and the condenser C. For example, control circuit SP-1 made by Yokogawa Thertec Co., Ltd. is employed as the control pack 24 and reversible motor RM-F6A3 made by Kyoei Communication Industry Co., Ltd. is also employed as the speed control motor 2.

Figure 5:
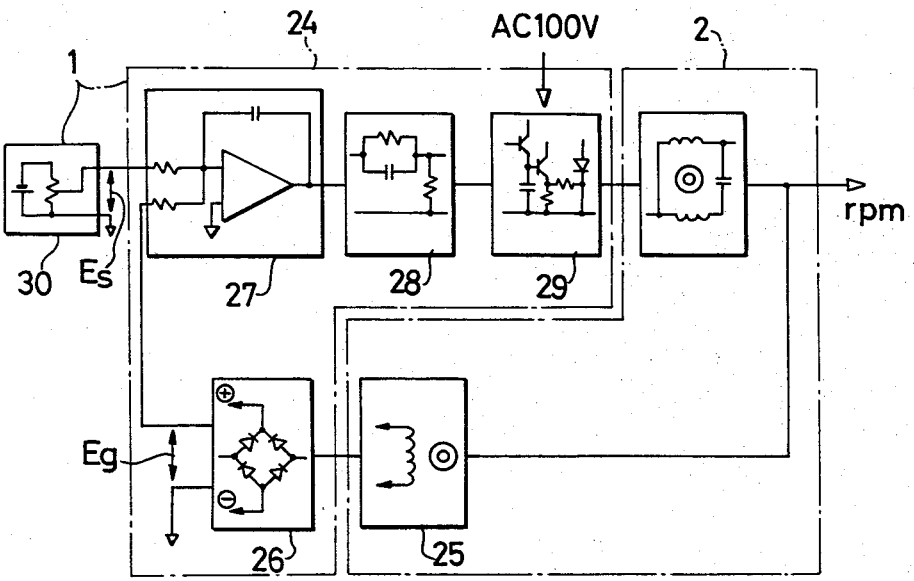
FIG. 5 is a block diagram showing the speed control by a variable speed type motor and a speed setting device.

The speed control operation will be described with reference to the block diagram of FIG. 5 showing the speed setting device according to the closed loop control system. For reference, Es is the speed setting signal across resistor 30 and is a DC voltage proportional to the set speed. An AC generator 25 is a component of the speed control motor 2 generating an AC voltage in proportion to the rotational speed. The AC voltage is converted to a direct current Eg by a full wave rectifier circuit 26 and is compared with the set voltage Es and the deviation signal (Es-Eg) is amplified by an operational amplifier 27. This output is supplied to a SCR control circuit 29 through a phase compensating circuit 28 to generate a pulse for triggering the SCR. The current is supplied to the motor 2 to generate the rotational torque only during conducting period of SCR.

To discharge liquid, the drive shaft 6 of the peristaltic pump 3 is rotated by driving the motor 2. The speed of the drive shaft is controlled by the speed setting device 1. The disk 9 mounted on the drive shaft 6 is rotated by the rotation of the drive shaft 6 and the rollers 11 mounted on the pins 10 of the disk 9 revolve about the drive shaft 6. The tube 13 press-fitted between the rollers 11 and the inside wall of the case 5 is squeezed and released by the revolution of the rollers 11 to introduce air from the air intake end 14 to supply air to the air discharge end 15. Air introduced into the reservoir 18 pressurizes liquid therein and the pressurized liquid is discharged from the nozzle 20 in a drop and string-shaped form.

Figure 6:
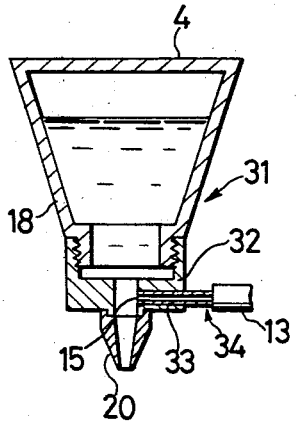
FIGS. 6 and 7 are perspective sectional views of modified discharging devices.
Figure 7:
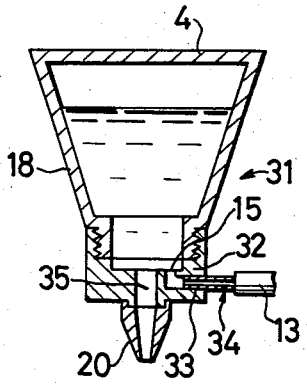

While the air discharge end is assumed to be in the opposite position from the nozzle in the above-mentioned embodiment, it may be provided at the side of the nozzle as is shown in FIGS. 6 and 7.

The discharging means 4, respectively shown in FIGS. 6 and 7 comprises a pressurized liquid reservoir 18 having a discharging means body 31 and a sealing cover 32. A nozzle 20 protruding from the cover 32 is provided with an air discharge port 33 into which a conduit 34 connected with the tube 13 is inserted. In this case the air discharge end 15 is a component of the air discharge port 33.

When applying liquid, the discharging device 4 is held by hand and the nozzle 20 is operated to bring it into near contact with materials to be applied. Alternatively, the application of materials may be effectuated by fixing the discharging device 4 and moving the materials to be applied. Moreover, the discharging device 4 may be designed in a variety of configurations, for example, as a cylindrical type, pen-holder type. The length of the nozzle may be also selected appropriately according to its purpose and scope of utility. For example, in the case where the portions to be applied are small or narrow, the long nozzle may be preferable. The nozzle may be provided at an end of the tube connecting to the discharging device.

With the above-mentioned configuration, the nozzle 20 is insulated-from liquid by placing the discharging means 4 upside down during the suspension of pen movement, and air introduced into the nozzle 20 prevents the nozzle from being clogged by the liquid. Therefore this system is advantageous for liquid liable to clog the nozzle, for example, adhesives and the like. Furthermore, since the liquid path 35 of the nozzle 20 is insulated from the air discharge port 33 in the discharging device 4 shown in FIG. 5, the flow of liquid is not blocked even if bubbles are produced. Hence, this is the most suitable means for a liquid with high viscosity and low fluidity.

Since this invention provides the sophisticated adjustment of the discharge amount of liquid to match the speed of individual user's pen by the use of the above-mentioned peristaltic pump, applying and filling-in operations can be carried out without the subsequent wiping-off and repairing processes. This tends to significantly improve the efficiency of work.

Also, since the forced feed means to the peristaltic pump always presses the elastic tube connected with the discharging device, it serves the function of a check valve to prevent the leakage from the air intake end and perform sanitary operation without pollution at any position of the discharging device.

It is apparent that modifications of this invention may be made without departing from the essential scope thereof.

What is claimed is:

1. An open loop system for selectively controlling and discharging liquid from a pressurized reservoir comprising:

peristaltic pump means having a depression and delivery system including forced feed means comprising an elastic tube (13) having an air intake end (14) for introducing air, pusher means (11) mounted for rotation on a drive shaft, said pusher means sequentially engaging said tube and squeezing and releasing said tube to produce an output, a continuously driven A.C. motor (2) connected to said drive shaft, speed setting means comprising a closed loop voltage control system (1) electrically connected with said A.C. motor for varying the rotational speed of said motor to regulate the output of said peristaltic pump in accordance with user demand, an air discharge end (15) of said elastic tube located within said pressurized liquid reservoir (18), to deliver the regulated output of said pump, and liquid discharge means (20) integral with said pressurized liquid reservoir discharging fluid from said reservoir in accordance with the user demand thereof as established by said speed setting means.

2. A liquid discharge apparatus as in claim 1, wherein said perstaltic pump means comprises at least two roller-shaped pushers of said forced feed means arranged to revolve along a circular path about said drive shaft to press said elastic tube press-fitted between said circular path and said pushers.

3. A liquid discharge apparatus as in claim 1, wherein said speed setting means comprising closed loop voltage control system is provided with a variable resistor (30) and a control circuit (24).

4. The liquid discharge device as in claim 3 wherein said control circuit comprises a source of D.C. voltage (25, 26), means for comparing said D.C. voltage with a control signal from said variable resistor and developing an output signal and pulse generating means responsive to said output signal to selectively control the rotational speed of said motor.

5. The liquid discharge device as in claim 4 wherein said pulse generating means comprises a phase compensating circuit receiving said output signal and a silicon controlled rectifier circuit to generate triggering pulses to said motor.

6. The liquid discharge device as in claims 1, 2, or 5 wherein said air discharge end of said elastic tube is disposed at one end of said reservoir and said liquid discharge means is disposed at an opposite end thereof.

7. The liquid discharge device as in claims 1, 2, or 5 wherein said reservoir further comprises a sealing cover (32) on to which said liquid discharge means is mounted and a conduit (34) receiving the air discharge end of said elastic tube.

8. The liquid discharge device as in claim 7 wherein said conduit has an internal end portion directed toward said liquid discharge means.

9. The liquid discharge device as in claim 7 wherein said conduit has an internal end portion directed into said reservoir.

* * * * *